US006399920B1

(12) United States Patent
Guinn

(10) Patent No.: US 6,399,920 B1
(45) Date of Patent: Jun. 4, 2002

(54) HEARING AID DRYING APPARATUS

(76) Inventor: James D. Guinn, 7703 S. 145$^{th}$ W. Ave., Sapulpa, OK (US) 74066

( * ) Notice: Subject to any disclaimer, the term of this patent is extended or adjusted under 35 U.S.C. 154(b) by 0 days.

(21) Appl. No.: 09/841,874

(22) Filed: Apr. 26, 2001

(51) Int. Cl.$^{7}$ ..... F26B 3/04; F27D 5/00; F27D 7/00

(52) U.S. Cl. ..... 219/386; 219/392; 219/400; 34/220

(58) Field of Search ..... 219/386, 392, 219/400; 34/218–220, 225, 80, 81

(56) References Cited

U.S. PATENT DOCUMENTS 5,640,783 A * 6/1997 Schumaier ..... 34/219
5,852,879 A * 12/1998 Schumaier ..... 34/80
D414,304 S * 9/1999 Schumaier ..... D32/1

FOREIGN PATENT DOCUMENTS

JP 9-108025 * 4/1997

* cited by examiner

*Primary Examiner*—Joseph Pelham
(74) *Attorney, Agent, or Firm*—Frank L. Hart

(57) ABSTRACT

An apparatus for removing moisture from a hearing aid by positioning the hearing aid in a chamber of preselected volume and passing heated air over the hearing aid and maintaining the first chamber within a preselected temperature range.

11 Claims, 1 Drawing Sheet

HEARING AID DRYING APPARATUS

TECHNICAL FIELD

The subject invention relates to an apparatus for drying a hearing aid. More particularly, the invention relates to an apparatus for heating a hearing aid to a temperature and time sufficient to remove moisture on and within the hearing aid.

BACKGROUND ART

In the construction of hearing aids, which are well known in the art, passageways are formed for directing sound waves adjacent a user toward the eardrum of the person wearing the hearing aid. Sensitive electronic/electrical apparatus are positioned within the hearing aid and in communication with the passageways. Therefore moisture from the air and from the skin of a user comes in contact with the electronic/electrical apparatus of the hearing aid.

It is well known that moisture coming in contact with the electronic/electrical apparatus of the hearing aid often damages the hearing aid to an extent that the hearing aid efficiency is seriously reduced or the hearing aid becomes inoperative. To reduce this problem, it is desirable to provide an apparatus for drying the moisture from the hearing aid during periods when the hearing aid is not in use.

DISCLOSURE OF THE INVENTION

In one aspect of the invention, an apparatus is provided which includes a container, a removable lid, and a plate and heating element connected to the container. The container has walls and first and second chambers. The first chamber has a volume in the range of about 4 to about 20 cubic inches. The removable lid is mateable with the container and defines an upper portion of the first chamber of the container. The plate has a plurality of openings extending therethrough and separates the first and second chambers one from the other. The heating element is positioned in the second chamber.

BEST MODE FOR CARRYING OUT THE INVENTION

Figure 1:
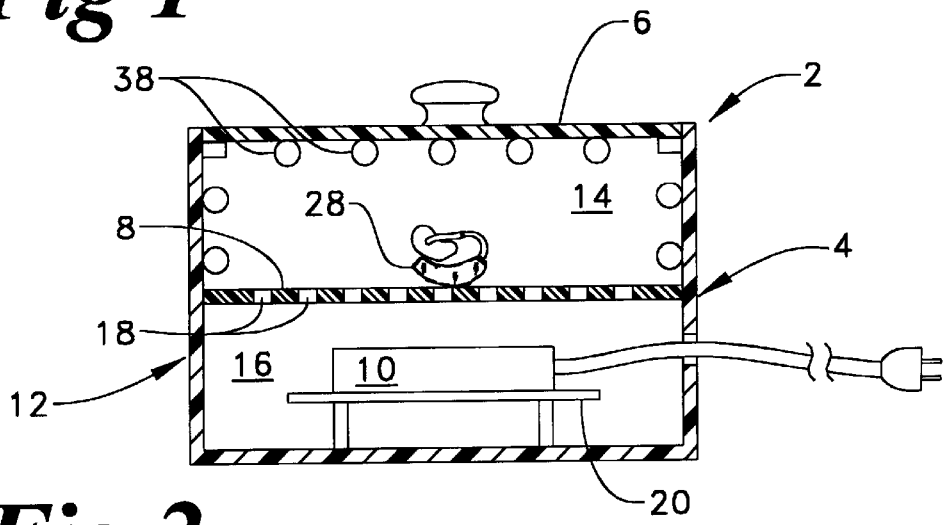
FIG. 1 is a diagrammatic sectional view of the apparatus of this invention.

Referring to FIG. 1, the apparatus 2 of this invention has a container 4, a removable lid 6, a dividing plate 8, and a heating element 10.

The container 2 has walls 12 and first and second chambers 14, 16. Preferably the container 2 is formed of organic plastic. However, it should be understood that the container 2 can be formed of other materials and in various configurations without departing from this invention. There is no preference in the kind of organic plastic that be used in forming the container 2 with the exception that the container not be damaged or melt at the temperatures which used.

The container 2 has a lid 6 that is mateable with upper end portion of the container and defines the first chamber 14. The lid 6 preferably has annular portions insertable into the first chamber. Such annular portions can extend over and along the walls 12 of the container 4 without departing from this invention.

Figure 2:
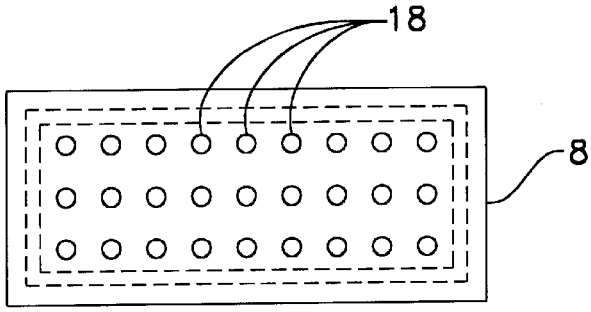
FIG. 2 is a diagrammatic top view of the plate of this invention.

Referring to FIGS. 1 and 2, the plate 8 has a plurality of openings 18 for the passage of heated air from the second chamber 16 into the first chamber 14. The plate 8 is connected to the container walls 12 and separates the first and second chambers 14, 16 one from the other. The plate 8 is preferably formed of organic plastic.

A heating element 10 is positioned in the second chamber 16 and is connected to the container 4. Referring to FIG. 1, the heating element 10 is located a preselected distance of at least about one-eighth inch from the plate 8 and is spaced from plate 8 by a table 20 which is connected to a base 22 of the container 4 and supports and maintains the heating element 10. In this embodiment of FIG. 1, the plate 8 and table 20 are preferably formed of organic plastic.

Figure 3:
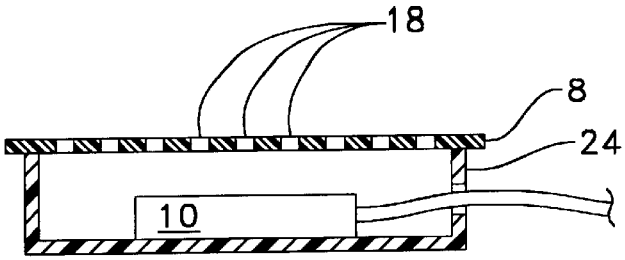
FIG. 3 is a diagrammatic frontal view in partial section of a portion of the plate and showing the positioning of the heating element and shelf.

Referring to FIG. 3, the spacing of the heating element 10 from an organic plastic plate 8 is achieved by forming a tray 24 which is connected to the plate 8 and supports the heating element 10 at a preselected location spaced from the plate 8 upon which a hearing aid 28 to be dried will be placed.

Figure 4:
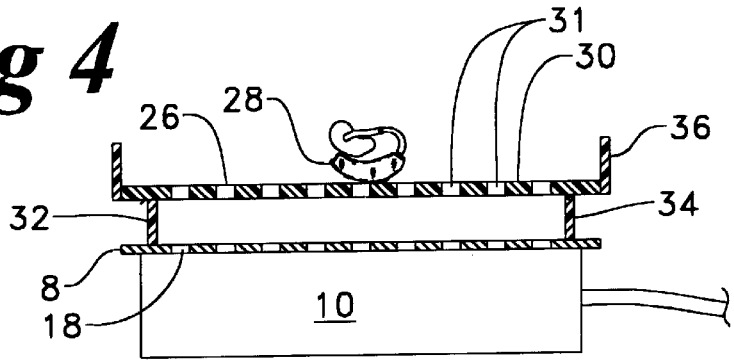
FIG. 4 is a diagrammatic frontal view in partial section of a portion of the plate, the heating element, and the tray of this invention.

Referring to FIG. 4, an embodiment of this invention is shown wherein the heating element 10 is directly connected to the plate 8. In this embodiment, the plate 8 is preferably formed of metal or an organic plastic that will withstand considerable heat. In this embodiment, the preferred spacing of the hearing aid from the heating element 10 is achieved by providing a tray 26 positionable within the first chamber 14 and supported by the plate 8. The tray 26 has a base 30 having holes 31 and legs 32, 34 extending from the base and contactable with said plate 8. The length of the legs assure that the hearing aid 28 on the tray 26 is maintained a distance of at least one-eighth inch from the heating element. The tray 26 preferably has side walls 36 extending upwardly about the tray periphery on an opposed side of said tray base 30 from the legs 32, 34 of said tray 26.

The heating element 10 is of a power sufficient to maintain the temperature in the first chamber 14 in the range of about 85 to about 120 degrees Fahrenheit. Temperatures less than about 85 degrees Fahrenheit are undesirable because extended the moisture will remain on and in the hearing aid for an accumulated length of time which will cause damage to the hearing aid. Temperatures greater than about 120 degrees Fahrenheit are undesirable because they represent a waste of time, equipment and natural resources and excessive heat can also cause damage to the hearing aid. The heating element 10 is preferably an electric heating element powered by house power.

In a preferred embodiment of the apparatus 2 of this invention, the heating element has a power rating in the range of about one watt to about three watts. A rating less than about one watt is undesirable because of accumulated time damaging moisture remains on the hearing aid and ratings greater than about 3 watts are undesirable because they represent a waste of materials and natural resources and may produce damaging excessive heat. A first chamber volume less than about 4 cubic inches is undesirable because two hearing aids being dried will restrict the circulation of heated air and undesirably extend drying time, as set forth above. A first chamber volume greater than about 20 cubic inches is undesirable because it represents a waste of materials and natural resources, as set forth above.

It should be understood that hearing aids are of different sizes and some people wear two hearing aids. It is therefore desirable to construct the heating element with a power rating sufficient to maintain the first chamber within the necessary volume range for maintaining the temperature within the first chamber within the necessary temperature range. One skilled in the art can easily accomplish this once the decision is made on whether the first chamber is to be constructed to accommodate small hearing aid or large hearing aids.

As shown in FIG. 1, it is preferred that at least one desiccant element 38 be positioned in the first chamber 14 to remove moisture from the air of said first chamber 14. The desiccant 28 can be connected to the lid 6, to the walls 12 of the first chamber 14 or to both.

INDUSTRIAL APPLICABILITY

In the operation of the apparatus of this invention, the user places his hearing aid or aids in the first chamber before going to bed. While he is sleeping, damaging moisture is evaporated from the hearing aid(s) thereby alleviating moisture damage.

Other aspects, objects and advantages of this invention can be obtained from a study of the drawings, the disclosure, and the appended claims.

What is claimed is:

1. An apparatus for drying a hearing aid, comprising:

a container having walls and first and second chambers, said first chamber having a volume in the range of about 4 to about 20 cubic inches;

a removable lid mateable with the container and defining an uppermost portion of the first chamber of the container;

a plate having a plurality of openings extending therethrough and being connected to the container walls and separating the first and second chambers one from the other;

a heating element positioned in the second chamber and connected to the plate, said heating element having a power rating sufficient for maintaining the temperature of the first chamber in the range of about 85 to about 120 degrees Fahrenheit; and a tray positionable within said first chamber and supported by said plate with an upper portion of said tray spaced a preselected distance from said heating element of at least one-eigth inch.

2. An apparatus, as set forth in claim 1, wherein the heating element is located a preselected distance of greater than about one-eighth inch from said plate.

3. An apparatus, as set forth in claim 1, wherein the heating element is of a power sufficient to maintain the temperature in the first chamber at about 100 degrees Fahrenheit.

4. An apparatus, as set forth in claim 1, including a desiccant connected to the apparatus and being positioned within the first chamber.

5. An apparatus, as set forth in claim 1, including a desiccant connected to the removable lid.

6. An apparatus, as set forth in claim 1, including a desiccant connected to the walls of the first chamber.

7. An apparatus, as set forth in claim 1, wherein the heating element has a power rating in the range of about 1 to about 3 watts.

8. An apparatus, as set forth in claim 1, wherein the container is formed of plastic.

9. An apparatus, as set forth in claim 1, wherein said tray has a perforated base and legs extending from said base and being contactable with said plate.

10. An apparatus, as set forth in claim 9, wherein said tray has side walls extending upwardly about the tray periphery on an opposed side of said tray base from said legs.

11. An apparatus, as set forth in claim 1 including a shelf connected to the plate and being positioned in the second chamber said heating element being connected to said shelf and to said plate via said shelf.

* * * * *

UNITED STATES PATENT AND TRADEMARK OFFICE

CERTIFICATE OF CORRECTION

PATENT NO. : 6,399,920 B1
DATED : June 4, 2002
INVENTOR(S) : James D. Guinn

It is certified that error appears in the above-identified patent and that said Letters Patent is hereby corrected as shown below:

Title page,
Item [75], the inventor's address should be:
-- James D. Guinn
8122 East 25th Place
Tulsa, Ok 74129 --

Signed and Sealed this

Twenty-first Day of January, 2003

JAMES E. ROGAN
*Director of the United States Patent and Trademark Office*